United States Patent [19]

Vock et al.

[11] Patent Number: 5,011,089

[45] Date of Patent: Apr. 30, 1991

[54] DISPERSING PROCESS AND STIRRED BALL MILL FOR CARRYING OUT THIS PROCESS

[75] Inventors: Friedrich Vock; Gerd Kissau; Klaus Warnke, all of Münster, Fed. Rep. of Germany

[73] Assignee: BASF Lacke+Farben AG, Münster, Fed. Rep. of Germany

[21] Appl. No.: 518,273

[22] Filed: May 4, 1990

Related U.S. Application Data

[63] Continuation of Ser. No. 298,783, Jan. 17, 1989, abandoned, which is a continuation of Ser. No. 893,302, filed as PCT EP85/00526 on Oct. 23, 1985, published as WO86/02286 on Apr. 24, 1986, abandoned.

[30] Foreign Application Priority Data

Oct. 16, 1984 [DE] Fed. Rep. of Germany ..... 3437866

[51] Int. Cl.[5] ..... B02C 17/16; B02C 23/10; B02C 23/36

[52] U.S. Cl. ..... 241/21; 241/24; 241/30

[58] Field of Search ..... 241/46.11, 46.17, 73, 241/79.2, 79.3, 172, 176, 180, 21, 24, 30

[56] References Cited

U.S. PATENT DOCUMENTS

| | | | |
|---|---|---|---|
| 2,592,994 | 4/1952 | Ahlmann . | |
| 3,251,578 | 5/1966 | Craig . | |
| 3,550,915 | 12/1970 | Kaspar et al. . | |
| 3,799,455 | 3/1974 | Szegvari | 241/27 |
| 4,044,957 | 8/1977 | Schold | 241/46.11 |
| 4,620,673 | 11/1986 | Canepa et al. | 241/172 X |
| 4,742,966 | 5/1988 | Szkaradek et al. | 241/171 X |

FOREIGN PATENT DOCUMENTS

| | | |
|---|---|---|
| 707525 | 6/1941 | Fed. Rep. of Germany . |
| 1902152 | 7/1970 | Fed. Rep. of Germany . |
| 2230766 | 5/1973 | Fed. Rep. of Germany . |
| 1572760 | 6/1969 | France . |
| 2433981 | 3/1980 | France . |
| 58-92468 | 6/1983 | Japan . |

*Primary Examiner*—Joseph M. Gorski
*Attorney, Agent, or Firm*—Kenyon & Kenyon

[57] ABSTRACT

In a dispersing process, a mill base consisting of solids and of a liquid phase is conveyed through a stirred ball mill containing a grinding medium, energy being supplied in this stirred ball by rotating rotors to disperse the solids are dispersed, wet with the liquid phase. The rotors rotate at such a high speed that the grinding medium moved by them forms, as the result of the centrifugal force, a rotating grinding medium charge which is in contact with the inner wall of the stirred ball mill, a space which is essentially free of a grinding medium being formed in the center of this grinding medium charge. The mill base is fed radially into the stirred ball mill and flows radially through the grinding medium charge in such a way that a centrifugal fluidized bed is formed with respect to the grinding medium. The mill base is removed from the space which is free of grinding medium through an apparatus such as a sieve for separating off grinding medium.

20 Claims, 9 Drawing Sheets

DISPERSING PROCESS AND STIRRED BALL MILL FOR CARRYING OUT THIS PROCESS

This application is a continuation of application Ser. No. 07/298,783 filed Jan. 1, 1989 and now abandoned which is a continuation of application Ser. No. 06/893,302 filed as PCT EP85/00526 on Oct. 23, 1985, published as WO86/02286 on Apr. 24, 1986 and now abandoned.

BACKGROUND OF THE INVENTION

The invention relates to a process for dispersing solids in a liquid phase.

It is known that solids can be dispersed in a liquid phase, for example pigments and fillers in a solution of a binder, in stirred ball mills by supplying mechanical energy. The stirred ball mills contain a grinding medium, for example sand, and the energy is supplied by the movement of rotors located in the stirred ball mill. In the dispersing processes used to date, 70 to 90% volume of the grinding chamber of the stirred ball mill is filled with sand. The mill base flows through the grinding chamber in an axial direction. The throughput of the mill base through the container is in general chosen so that the prescribed desired fineness is achieved after one or more passes. This procedure is frequently referred to as the one-pass or multi-pass procedure.

The level of production achievable by this procedure, that is to say the amount of finished mill base produced per hour, can be increased substantially if the procedure described in German Patent Specification 2,230,766 or German Laid-Open Application 1,902,152 is used. In this circulatory procedure, the throughput of mill base through the mill is high, and , after leaving the mill, the mill base flows back into a container, from which it is conveyed again into the mill by means of a pump. The same effect can be achieved if, using so-called pendulum procedure, the mill base flows through the stirred ball mill with high throughputs from one container into a second container. This process is repeated until the desired fineness is achieved.

Furthermore, it is known that the level of production can be increased when finer grinding media are used. In the circulatory procedure or pendulum procedure described, the high throughput of mill base causes relatively high drag forces to act on the fine grinding medium, which is then conveyed with the flow towards the grinding medium separating system of the stirred ball mill.

In these procedures, achieving a very hard-wearing seal for the moving parts of the stirred ball mill and separating off the grinding medium from the mill base leaving the stirred ball mill present problems. For the latter purpose, sieves are employed, these being exposed to a great deal of wear due to friction with the grinding medium.

SUMMARY OF THE INVENTION

It is an object of the invention to provide a dispersing process which overcomes the disadvantages of the prior art and permits rapid and effective dispersing.

Surprisingly, it has been found that this object can be achieved by reducing the relative charge of grinding medium in the container, and choosing the speed of the rotors so that the grinding medium charge forms a hollow rotating cylinder in the stirred ball mill as a result of the centrifugal force.

In a method for dispersing solids in a liquid phase in accordance with the present invention, a mill base comprising solids and a liquid phase is fed to a hollow body having a substantially cylindrical inner surface and containing a grinding medium. The mill base is fed radially inwardly into the hollow body, while the grinding medium is rotated relative to the hollow body at such a speed that the grinding medium forms an annular charge in contact on an outer side with the cylindrical inner surface of the hollow body and defining on an inner side a cylindrical space free of the grinding medium. The mill base is conveyed radially inwardly through the cylindrical charge of grinding medium so that a fluidized bed is formed with respect to the grinding medium. Preferably, the mill base is sifted by means of a cylindrical sieve disposed centrally in the hollow body or by means of a plurality of cylindrical sieves disposed in a circular array about a longitudinal axis of the hollow body. The sieves may be stationary or rotatable with respect to the hollow body.

Because the mill base is fed in radially, the path of the mill base through the grinding medium charge is shorter than in prior art procedures. This compensated by virtue of the fact that the mill base has to pass the grinding medium charge more frequently. The drag forces acting radially from the outside towards the inside cause fluidisation of the grinding medium in the centrifugal field. In general, it is advantageous to choose a high radial flow velocity. Surprisingly, in spite of this high flow velocity, very effective dispersing is achieved, the total dispersing time and the cost of monitoring the process being reduced in the circulatory procedure and the pendulum procedure. In this procedure, dispersing of temperature-sensitive goods can also be carried out without difficulty, since only a small increase in the temperature of the mill base can be observed per passage through the stirred ball mill. This supplied heat can readily be removed from the mill base again in an external cooler. In addition, substantial reduction in the dispersing energy employed is achieved with this procedure compared with the procedure involving passes.

In this dispersing process, fine grinding media can be employed with high throughputs through the mill; these grinding media cannot be used in machines corresponding to the prior art because they are carried onto the separation sieve at high throughputs.

The invention also relates to a stirred ball mill for carrying out the dispersing process.

Such a stirred ball mill comprises a hollow body having a substantially cylindrical inner surface and containing a grinding medium. An input line extends to the hollow body for feeding, radially inwardly into the hollow body, a mill base comprising solids and a liquid phase. A rotation device is provided in the hollow body for rotating the grinding medium relative thereto at such a speed that the grinding medium forms an annular charge in contact on an outer side with the cylindrical inner surface of the hollow body and defining on an inner side a cylindrical space free of the grinding medium. A sieve is disposed inside the hollow body for sifting the mill base during a movement of the mill base through the cylindrical space upon a movement of the mill base radially inwardly through the grinding medium charge.

DETAILED DESCRIPTION

Figure 1:
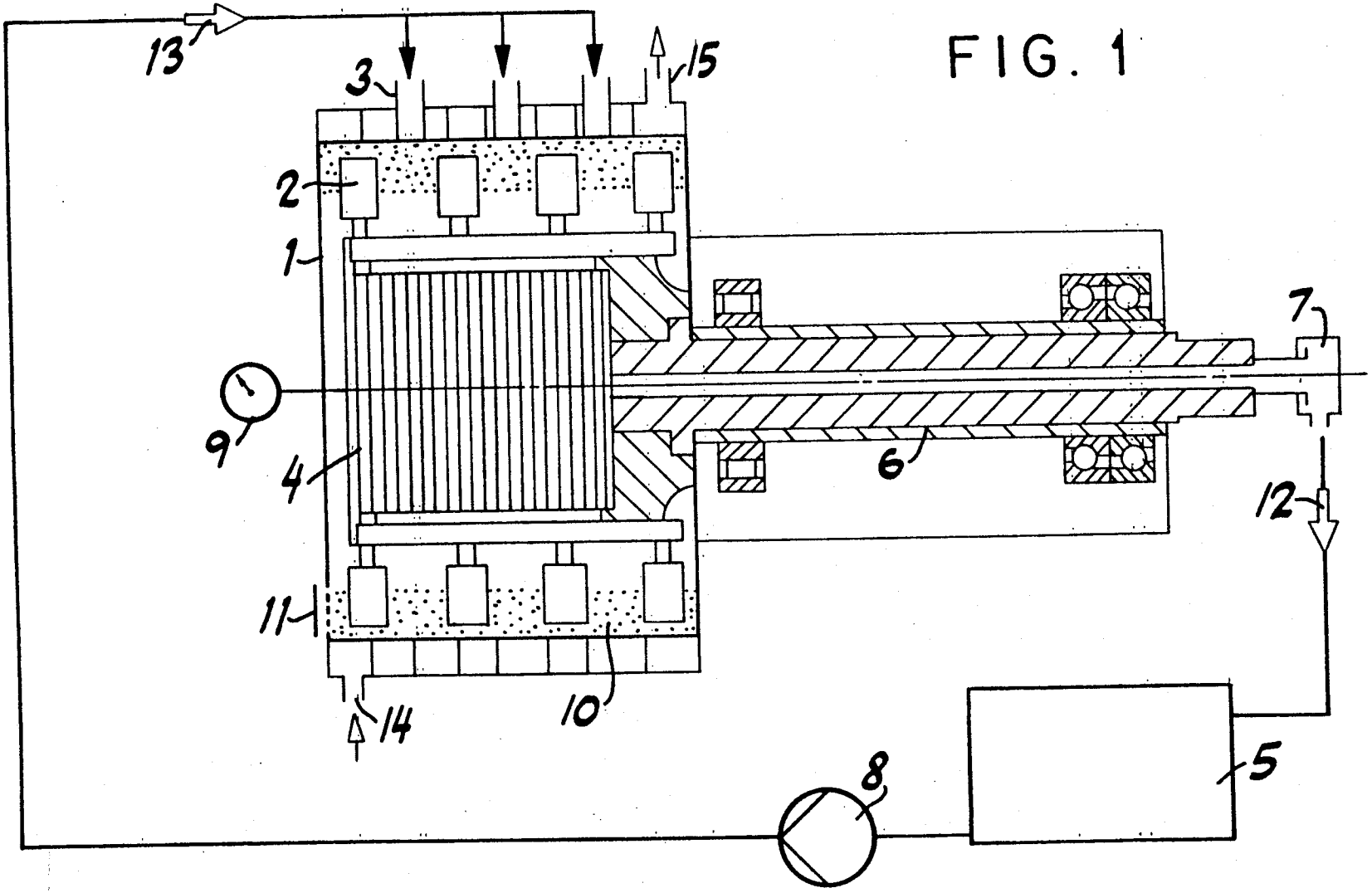
FIG. 1 shows a vertical longitudinal section through a stirred ball mill, according to the present invention.

In the drawings, reference numeral 1 denotes a container in which rotors 2 in the form of paddles are located. The mill base is fed in at 3, and reference designation 4 represents a sieve. Reference numeral 5 denotes a stock vessel. The rotors 2 are driven via a hollow shaft 6, which also serves for removal of the mill base. Reference numeral 7 represents a gland, and reference designation 8 denotes the required pump. Numeral 9 denotes a manometer and numeral 10 denotes the grinding medium charge inside the container 1.

Reference denotation 11 represents a discharge sieve for residual products, and the outflow of mill base is, indicated by an arrow 12, while the inflow of mill base is, indicated by an arrow 13. Numeral 14 represents the inflow of cooling water, and numeral 15 represents the outflow of cooling water.

Figure 2:
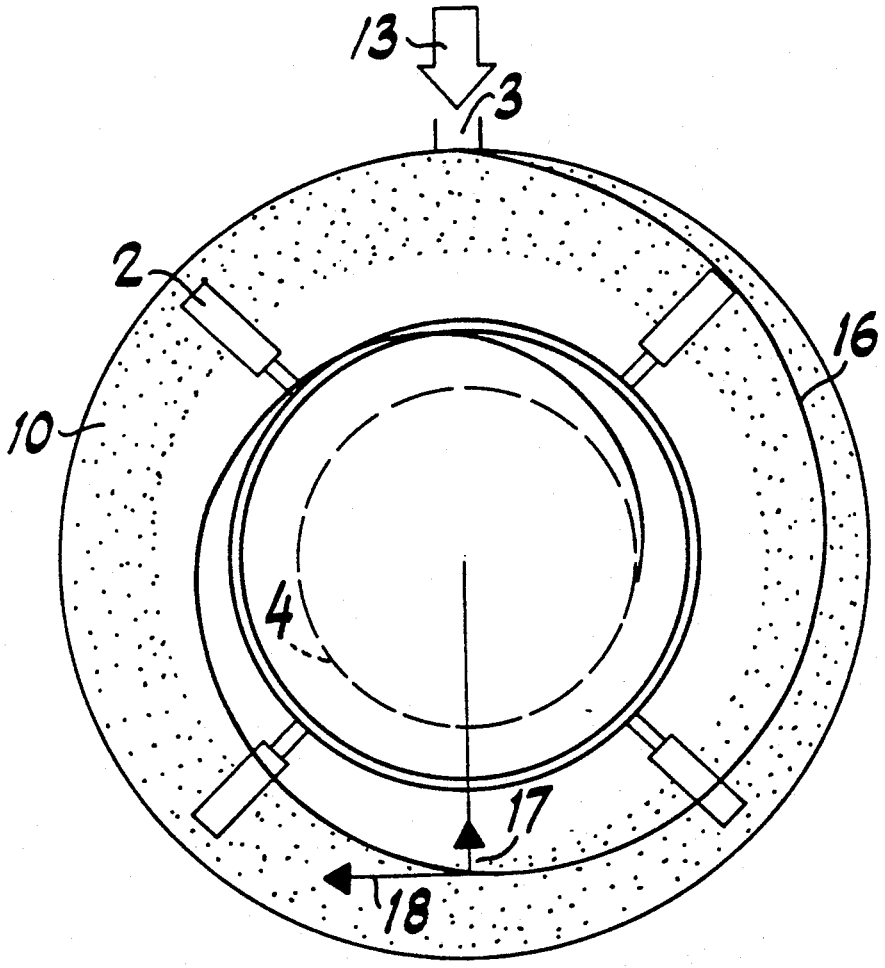
FIG. 2 shows a vertical transverse section through another stirred ball mill according to the present invention.

In FIG. 2, reference designation 16 represents an idealised mill base path, while the arrows 17 and 18 indicate, respectively, the radial velocity of the mill base and the peripheral velocity of the mill base.

In an illustrative example, the mill base consists of:

30.5% by weight of an alkyd resin 60.5% by weight of titanium dioxide;

8.0% by weight of an aromatic solvent; and 1.5% by weight of additives, 90 kg of this mill base are predispersed in a dissolver. Thereafter, dispersing is carried out by means of the stirred ball mill shown in the figure.

Machine conditions in the above-delineated example are as follows:

Throughput: 900 kg/h

Rotary speed: 650 rpm

Effective power consumption: 10.8 kw

Grinding medium volume: 15 L type of grinding medium: silicon/zirconium oxide grinding medium (diameter 0.6–2.5 mm)

Measurement of the maximum sizes of the solid particles according to Hegman gave a value of 100 μm after predispersing in the dissolver, and a value of 6 μm after dispersing for 30 minutes in the stirred ball mill. This gives a production rate of 180 kg/h.

It is known that grinding medium charges in stirred ball mills are subject to wear, the resulting loss of grinding medium must be replaced from time to time to ensure optimum operation, and the amount of grinding medium to be replaced is most advantageously determined via the power consumption of the rotating rotor of the stirred ball mill, however, in the case of stirred ball mills based on present-day technology, this is possible only with very expensive topping-up apparatuses, but is achieved in a surprisingly simple manner according to the invention, in which the required supplementary amounts of grinding medium can be metered, with the rotor running, freely via a feed pipe into the centre which is free of grinding medium, unitl a prescribed set value of the power consumption of the rotor is achieved.

Figure 3:
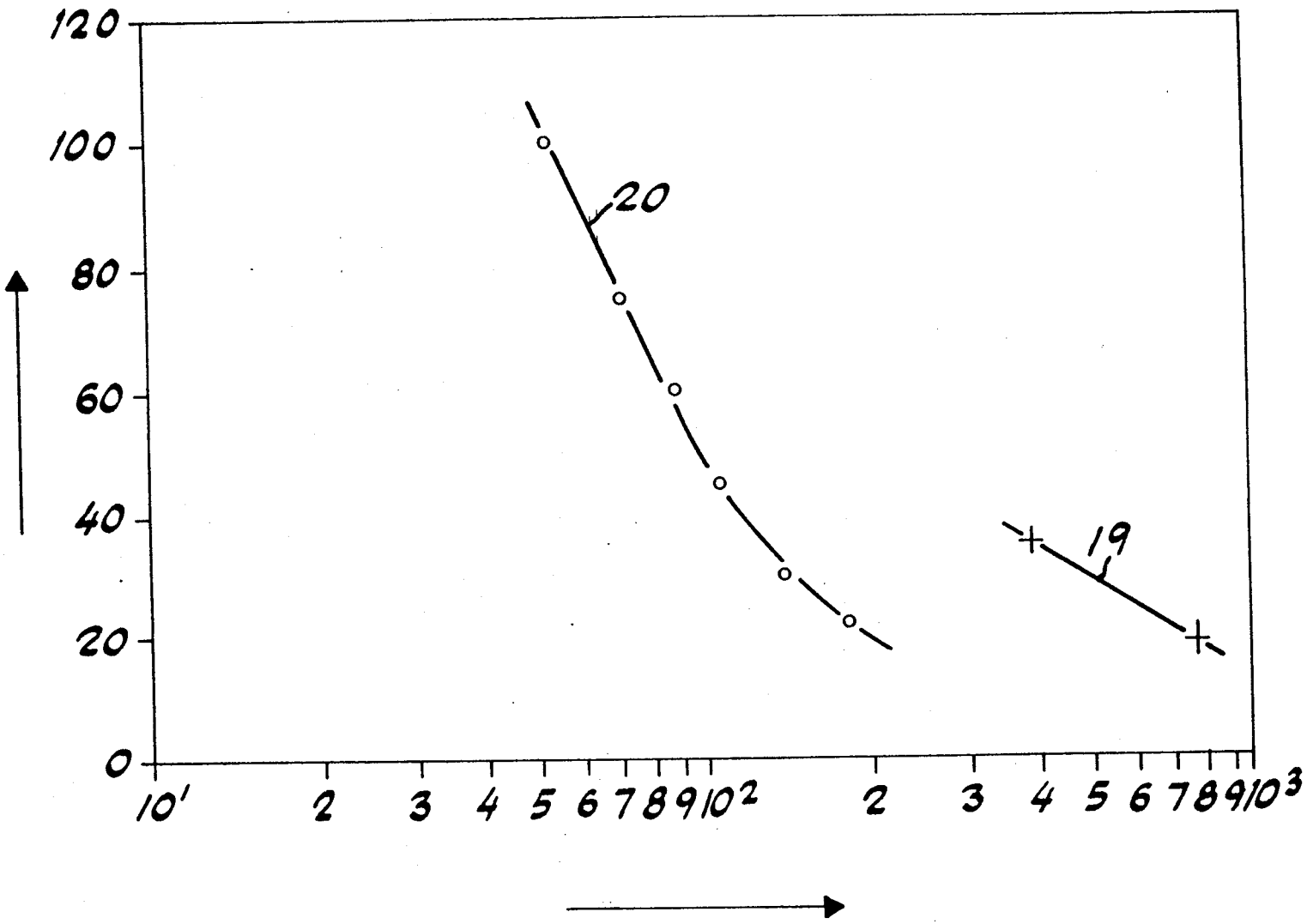
FIG. 3 shows the variation of the fineness of a suspension as a function of time, for a stirred ball mill according to the present invention.

In the graph shown in FIG. 3, the fineness (Xmax Hegman) of a suspension is plotted along the ordinate, as a function of time. The curve 19 shows that the suspension has reached a Hegman fineness of 35 μm after a pass corresponding to 400 minutes, and has reached a fineness. of 19μm after two passes corresponding to 780 minutes. The curve 20 shows that this result can be achieved in a substantially shorter time using a circulatory procedure.

Figure 4:
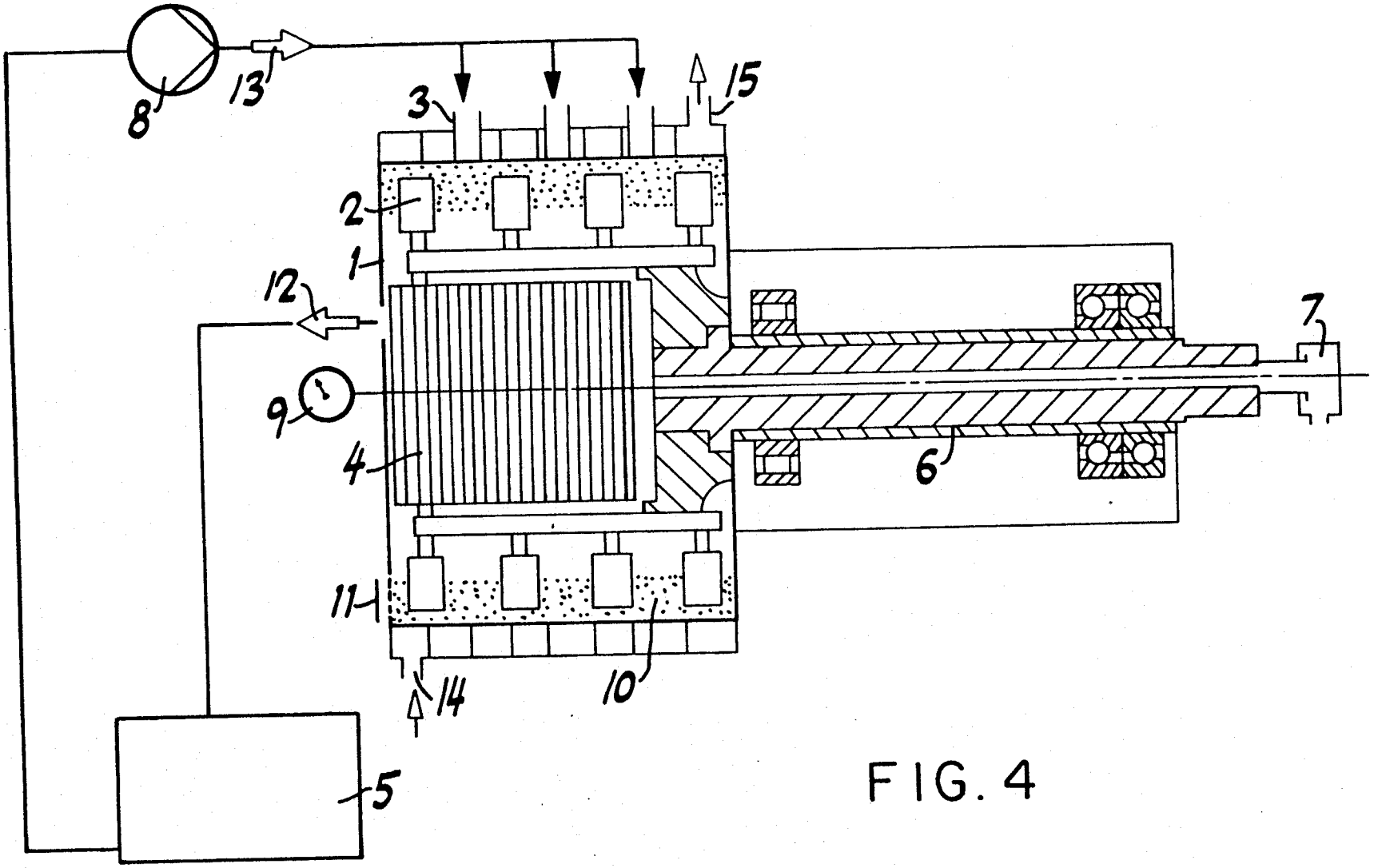
FIG. 4 shows a section corresponding to FIG. 1 but with a stationary cylindrical separating, sieve.

FIG. 4 shows, as in FIG. 1, a cross-section through a stirred ball mill according to the invention, but in this case with a stationary cylindrical separating sieve 4.

Figure 5:
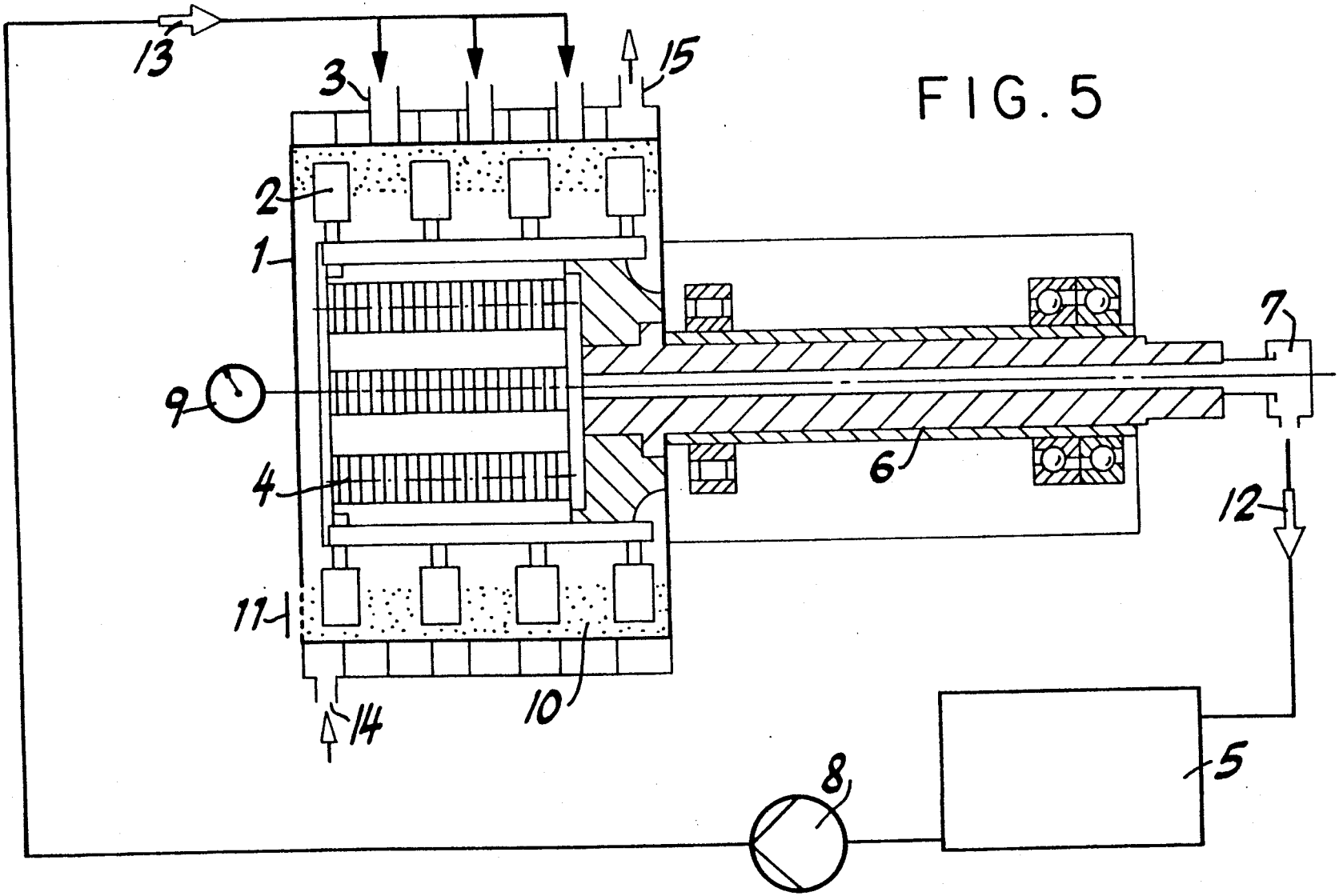
FIG. 5 shows a longitudinal section through a stirred ball mill similar to the mill of FIG. 1 but with sieves arranged along part of a circle.
Figure 6:
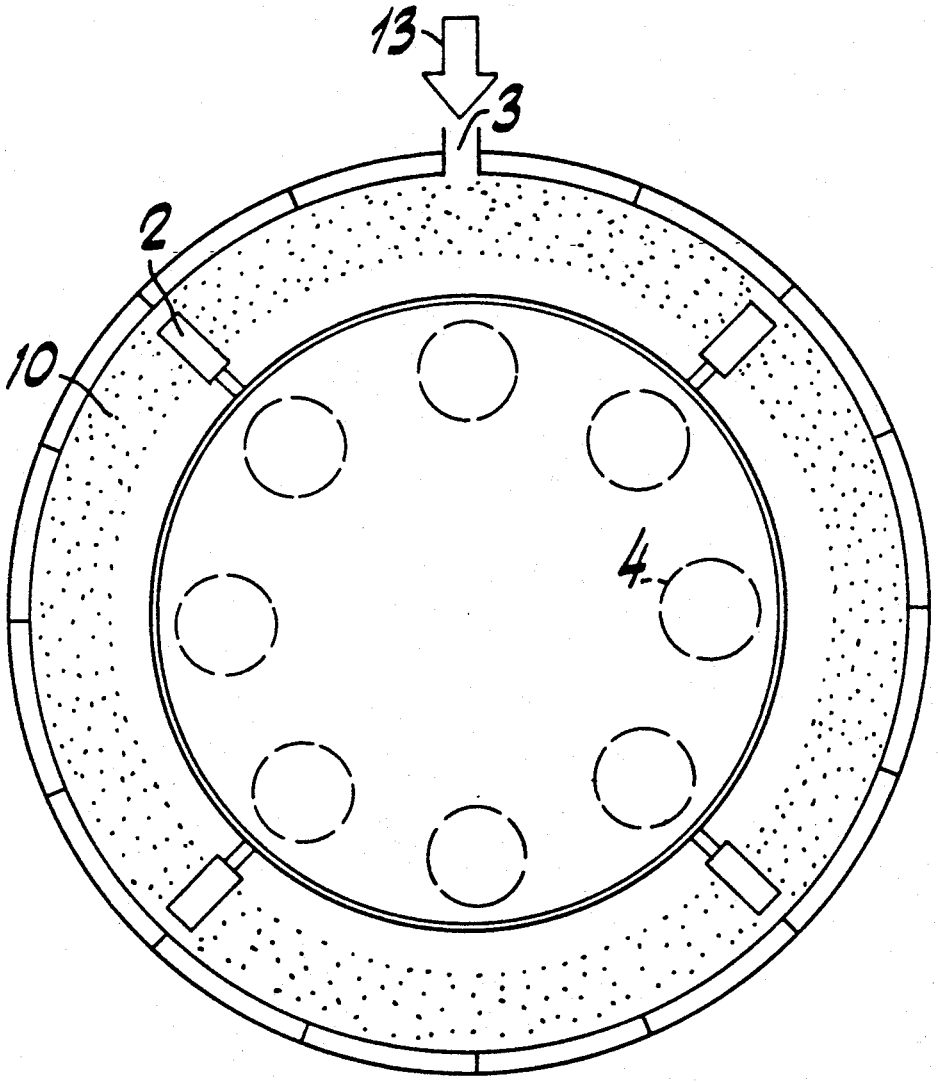
FIG. 6 shows a transverse section of the stirred ball mill of FIG. 5.

FIGS. 5 and 6 show longitudinal and transverse sections through a stirred ball mill, but in this case with sieves 4 arranged along part of a circle and rotating together with the drive shaft.

Figure 7:
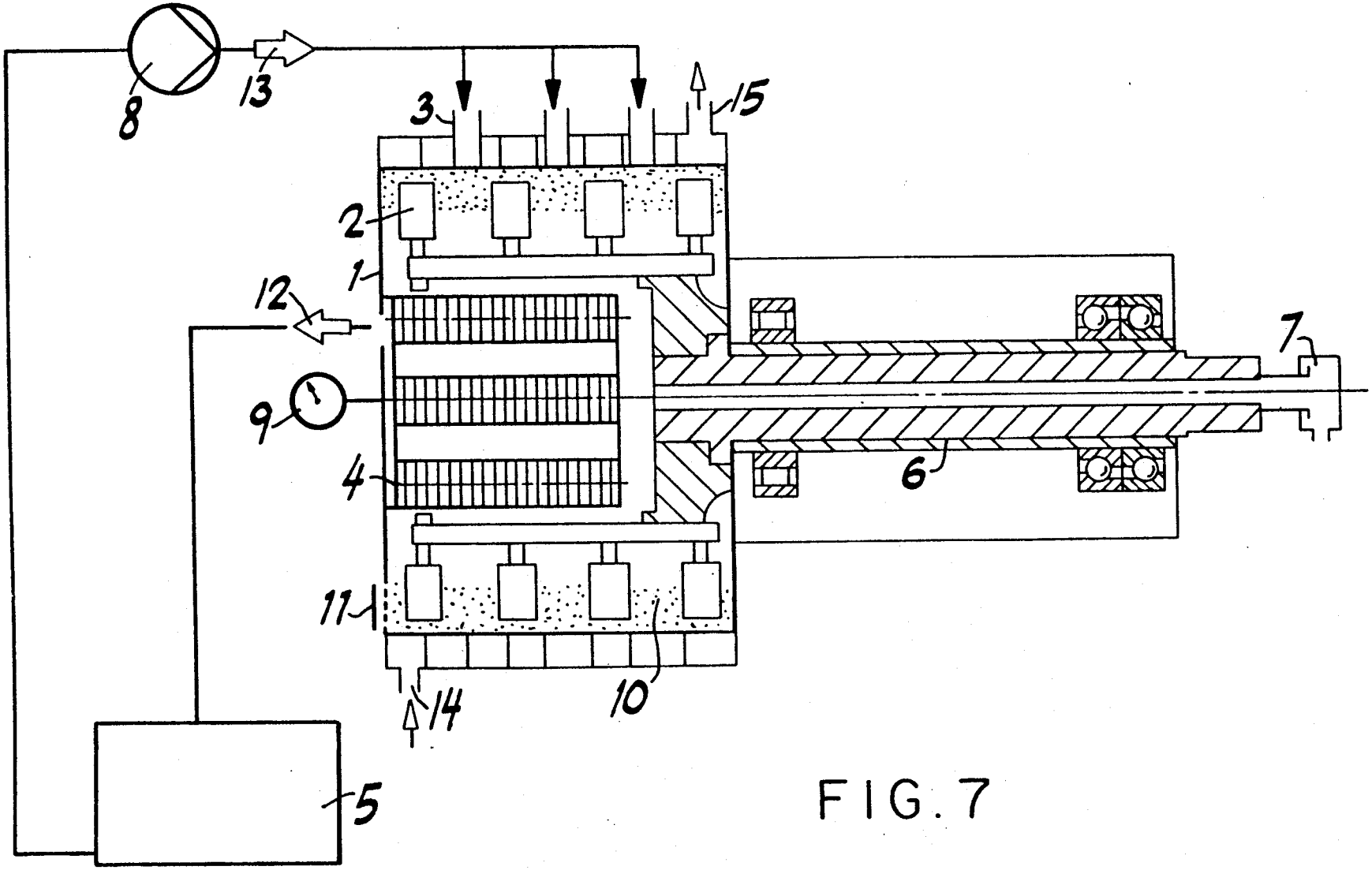
FIG. 7 shows a stirred ball mill with stationary sieves disposed in a circular array.

FIG. 7 shows sieves 4 which are arranged along part of a circle in a manner corresponding to FIG. 5 but in this case are in the form of stationary, i.e. non-rotating, sieves.

Figure 8:
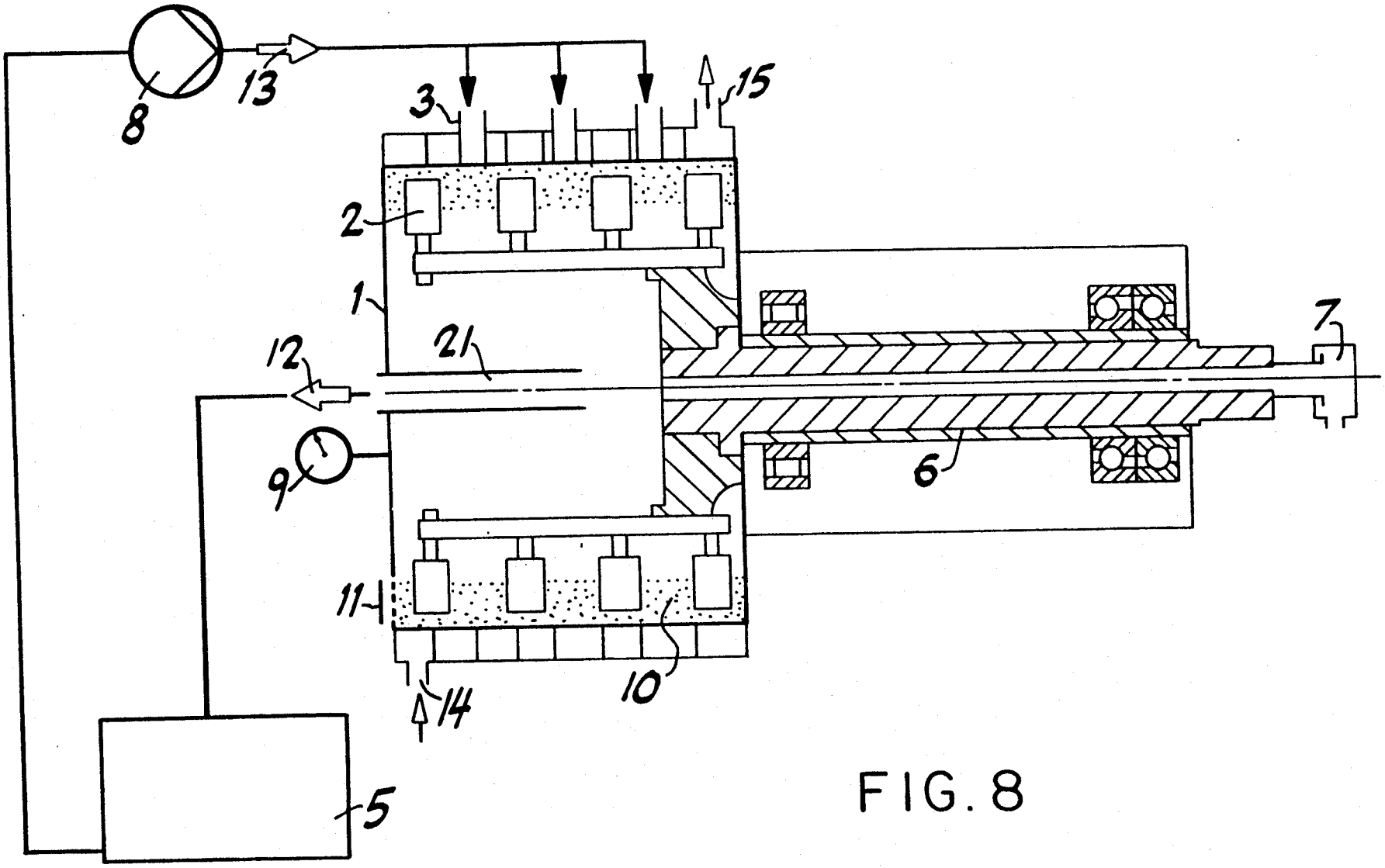
FIG. 8 shows a stirred ball mill with a stationary syphon tube and FIG. 9 shows a stirred ball mill with a sieve rotating in a central space free of grinding medium.

FIG. 8 shown, as the apparatus for separating off grinding medium, a stationary syphon tube 21 which projects into the space which is free of grinding medium. A sieve is not provided.

Figure 9:
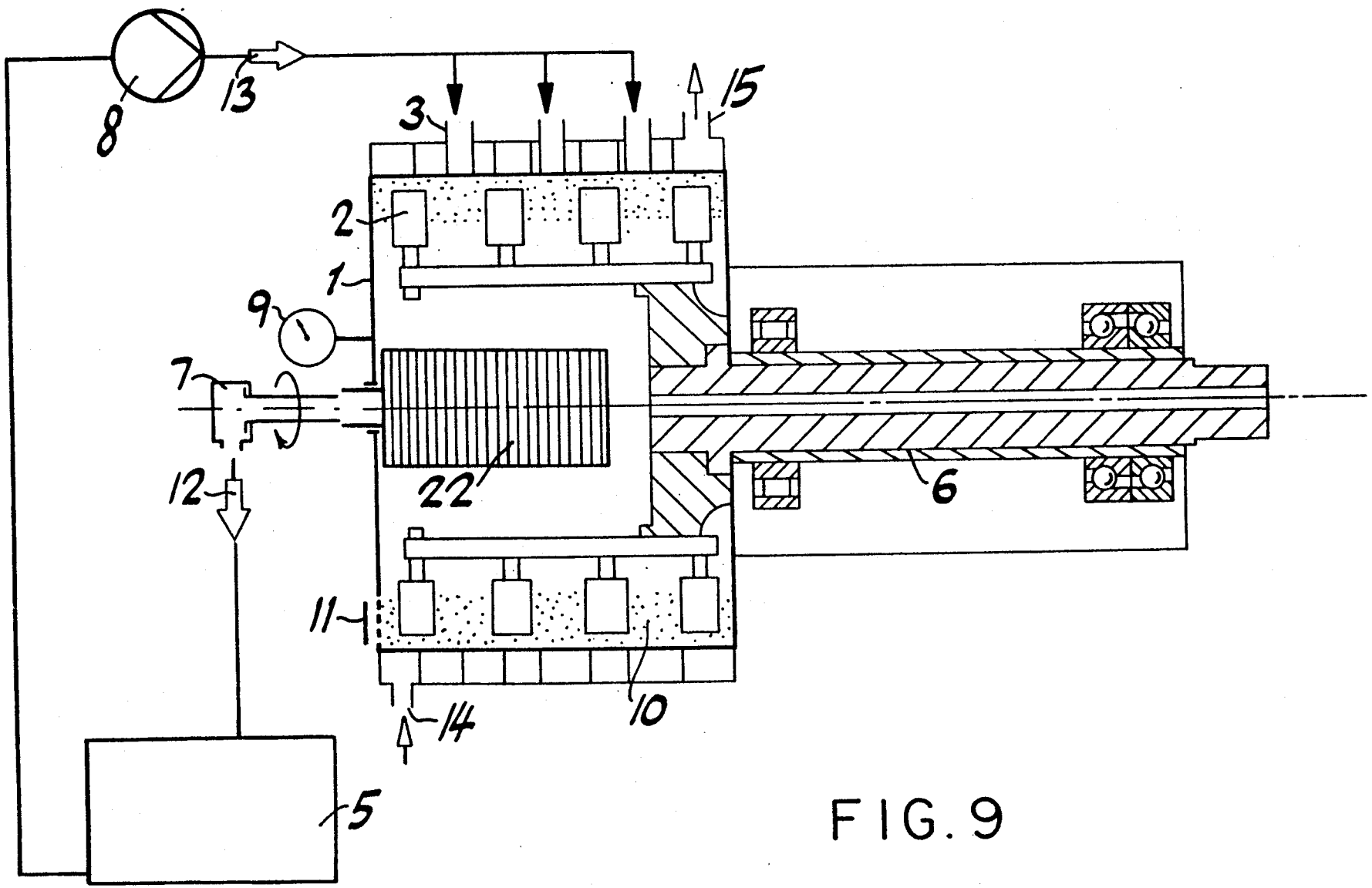

FIG. 9 shows, as the apparatus for separating off grinding medium, a sieve 22 which rotates in the space free of grinding medium and the speed of which is independent of the speed of the rotor drive.

What is claimed is:

1. A method of dispersing solids in a liquid phase comprising the steps of:

feeding a mill base comprising solids and a liquid phase into a hollow body having a substantially cylindrical inner surface and containing a grinding medium and a sieve means, said mill base being fed radially inwardly with respect to said hollow body into said hollow body;

rotating said grinding medium relative to said hollow body and sieve means at such a speed that the grinding medium forms an annular charge in contact on an outer side with said cylindrical inner surface and defining on an inner side a cylindrical space essentially free of said grinding medium in which cylindrical space is situated the sieve means, such that the annular charge rotates around the sieve means without substantially colliding with said sieve means;

conveying said mill base radially inwardly with respect to said hollow body through said charge toward the sieve means so that a fluidized bed is formed with respect to said grinding medium; and passing said mill base radially inwardly with respect to said hollow body through said sieve means, thereby separating said mill base from any residual grinding medium.

2. The method defined in claim 1 wherein said hollow body has a predetermined volume, further comprising the step of controlling the quantity of said grinding medium in said hollow body so that said grinding medium occupies 20–50% of said volume.

3. The method defined in claim 1 wherein said sieve means comprises a cylindrical sieve disposed centrally in said hollow body.

4. The method defined in claim 3, further comprising the step of rotating said sieve relative to said hollow body.

5. The method defined in claim 4 hwerein said hollow body has a predetermined length and wherein said sieve has a length at least 50% of said predetermined length.

6. The method defined in claim 4 wherein said sieve is rotated in a direction and at a speed independently of a direction and speed of rotation of said grinding medium relative to said hollow body.

7. The method defined in claim 3 wherein said sieve is stationary with respect to said hollow body.

8. The method defined in claim 7 wherein said hollow body has a predetermined length and wherein said sieve has a length at least 50% of said predetermined length.

9. The method defined in claim 1 wherein said sieve means comprises plurality of cylindrical sieve disposed in a circular array about a longitudinal axis of said hollow body.

10. The method defined in claim in 9, further comprising the step of rotating said sieves relative to said hollow body.

11. The method defined in claim 10 wherein said hollow body has a predetermined length and wherein said sieves have a common length at least 50% of said predetermined length.

12. The method defined in claim 10 wherein said sieves are fixed with respect to one another and are rotated about a longitudinal axis of said hollow body in a direction and at a speed independently of a direction and speed of rotation of said grinding medium relative to said hollow body.

13. The method defined in claim 9 wherein said sieves are stationary with respect to said hollow body.

14. The method defined in claim 13 wherein said hollow body has a predetermined length and wherein said sieves have a common length 50% of said predetermined length.

15. The method defined in claim 1 wherein said hollow body has a predetermined length and wherein said step of feeding comprises the step of feeding said mill base to said hollow body at a plurality of points longitudinally spaced from one another along said length.

16. The method defined in claim 1 wherein said hollow body has a predetermined length and wherein said step of feeding comprises the steps of feeding said mill base to said hollow body along a slot extending longitudinally along said length.

17. The method defined in claim 1, further comprising the steps of automatically sensing pressure of liquid in said space and controlling the speed of rotating said grinding medium relative to said hollow body in accordance with the sensed pressure.

18. The method defined in claim 17 wherein said hollow body has a lid side and wherein said pressure is sensed along said lid side.

19. The method defined in claim 1, further comprising the steps of automatically sensing pressure of liquid in said space and controlling the rate that said mill base is fed to said hollow body in accordance with the sensed pressure.

20. The method defined in claim 19 wherein said hollow body has a lid side and wherein said pressure is sensed along said lid side.

* * * * *

UNITED STATES PATENT AND TRADEMARK OFFICE

CERTIFICATE OF CORRECTION

PATENT NO. : 5 011 089

DATED : April 30, 1991

INVENTOR(S) : Friedrich VOCK et al.

It is certified that error appears in the above-identified patent and that said Letters Patent is hereby corrected as shown below:

On the title page

[63] ...filed as PCT EP85/00526 on October 9, 1985...

In Column 1, line 6, chnge "Oct. 23" to read --Oct. 9--;

in Column 1, line 20, change "volume" to read --by volume--;

in Column 3, line 31, change "Numeral" to read --Reference numeral--;

in Column 3, line 45, change "resion" to read --resion;--;

in Column 3, line 58, change "type" to read --Type--;

in Column 4, line 3, change "mill," to read --mill;--;

in Column 4, line 10, change "unitl" to read --until--;

in Column 4, line 18, change "fineness." to read --fineness--;

in Column 5, line 25, change "sieve" to read --sieves--;

UNITED STATES PATENT AND TRADEMARK OFFICE

CERTIFICATE OF CORRECTION

PATENT NO. : 5 011 089

DATED : April 30, 1991

INVENTOR(S) : Friedrich VOCK et al.

It is certified that error appears in the above-identified patent and that said Letters Patent is hereby corrected as shown below:

in Column 6, line 8, change "length" to read --length at least--.

Signed and Sealed this

Twenty-seventh Day of April, 1993

*Attest:*

MICHAEL K. KIRK

*Attesting Officer*

*Acting Commissioner of Patents and Trademarks*